US009820901B2

(12) United States Patent
Brown et al.

(10) Patent No.: US 9,820,901 B2
(45) Date of Patent: Nov. 21, 2017

(54) PATIENT ASSISTANCE AND REHABILITATION DEVICE AND METHOD OF USE

(71) Applicants: Adam Brown, River Heigths, UT (US); Rex Spendlove, Millville, UT (US)

(72) Inventors: Adam Brown, River Heigths, UT (US); Rex Spendlove, Millville, UT (US)

( * ) Notice: Subject to any disclaimer, the term of this patent is extended or adjusted under 35 U.S.C. 154(b) by 272 days.

(21) Appl. No.: 14/710,597

(22) Filed: May 13, 2015

(65) Prior Publication Data

US 2016/0331610 A1 Nov. 17, 2016

(51) Int. Cl.

| | |
|---|---|
| ***A61G 5/08*** | (2006.01) |
| ***A61G 5/10*** | (2006.01) |
| ***A61G 5/14*** | (2006.01) |
| ***A61G 7/10*** | (2006.01) |
| ***A61H 3/04*** | (2006.01) |

(52) U.S. Cl.

CPC ..... *A61G 5/14* (2013.01); *A61G 5/0833* (2016.11); *A61G 5/1002* (2013.01); *A61G 7/1046* (2013.01); *A61H 3/04* (2013.01); *A61G 5/1005* (2013.01); *A61G 2200/36* (2013.01)

(58) Field of Classification Search

CPC .... A61G 5/0808; A61G 5/0833; A61G 5/085; A61G 5/0875; A61G 5/1002; A61G 5/1005; A61G 5/109; A61G 5/14; A61G 7/1007; A61G 7/1015; A61G 7/1017; A61G 7/1019; A61G 2200/36; A61G 7/1046; A61H 3/04; A61H 2003/046; A63B 21/0407; A63B 21/4029; A63B 21/4031

See application file for complete search history.

(56) References Cited

U.S. PATENT DOCUMENTS

| | | | | | |
|---|---|---|---|---|---|
| 2,962,730 | A * | 12/1960 | Carnes | A61G 7/053 | 254/7 R |
| 2,981,312 | A * | 4/1961 | Sundberg | A61H 3/04 | 188/5 |
| 3,277,502 | A * | 10/1966 | Wauthier | A61G 7/1017 | 280/304.1 |
| 3,629,880 | A * | 12/1971 | van Rhyn | A61G 7/1017 | 280/250 |
| 3,940,808 | A * | 3/1976 | Petrini | A61G 7/1019 | 5/81.1 RP |
| 4,704,749 | A * | 11/1987 | Aubert | A61G 7/1019 | 280/250.1 |
| 4,941,708 | A * | 7/1990 | Heffner | A61G 7/1015 | 135/67 |
| 4,985,947 | A * | 1/1991 | Ethridge | A61G 7/1017 | 280/250.1 |
| 5,148,559 | A * | 9/1992 | Morris | A61G 5/00 | 297/344.21 |

(Continued)

FOREIGN PATENT DOCUMENTS

| | | | | |
|---|---|---|---|---|
| GB | 1414644 A | * 11/1975 | ..... | A61G 7/1019 |

*Primary Examiner* — Joseph M Rocca
*Assistant Examiner* — Maurice L Williams
(74) *Attorney, Agent, or Firm* — J. Todd Rushton

(57) ABSTRACT

A patient assistance and rehabilitation device or more specifically a patient mechanical lift device that can be utilized as patient walker, a seat, a seated transporter, a toilet, a table and a rehabilitation device. The patient assistance and rehabilitation device including a power band or tension motor to help a patient move from a sitting to a standing position and to supplement an exercise or rehabilitation program.

20 Claims, 10 Drawing Sheets

(56) References Cited

U.S. PATENT DOCUMENTS 5,185,895 A * 2/1993 Gagne ..... A61G 7/1019 5/83.1
5,309,584 A * 5/1994 Parker ..... A61G 7/1017 5/86.1
5,411,044 A * 5/1995 Andolfi ..... A61G 7/1019 135/66
5,502,851 A * 4/1996 Costello ..... A61H 3/04 482/69
5,697,628 A * 12/1997 Spear ..... A61G 5/12 280/304.1
5,800,318 A * 9/1998 Coviello ..... A61H 3/04 135/67
5,878,450 A * 3/1999 Bouhuijs ..... A61G 7/1017 5/83.1
5,937,959 A * 8/1999 Fujii ..... A61G 5/047 180/12
6,053,519 A * 4/2000 Poindexter ..... A61G 5/042 180/907
6,092,247 A * 7/2000 Wilson ..... A61G 7/1011 5/81.1 R
6,430,761 B1 * 8/2002 Brandorff ..... A61G 7/053 5/81.1 R
6,568,002 B1 * 5/2003 Liljedahl ..... A61G 7/1017 5/81.1 R
6,643,869 B1 * 11/2003 Sloan, Jr. ..... A61G 7/10 280/304.1
7,003,820 B1 * 2/2006 Iura ..... A61G 7/053 135/67
9,295,597 B2 * 3/2016 Hjort ..... A61G 5/14
2008/0079230 A1 * 4/2008 Graham ..... A61G 5/08 280/87.041
2008/0121259 A1 * 5/2008 Weaver ..... A61G 5/14 135/67
2009/0249544 A1 * 10/2009 Palay ..... A61G 5/14 5/83.1
2010/0154115 A1 * 6/2010 Wernqvist ..... A61G 7/1017 5/86.1
2010/0287698 A1 * 11/2010 Stryker ..... A61G 5/1059 5/87.1
2011/0227379 A1 * 9/2011 Fogleman ..... A61G 7/1019 297/217.1
2012/0104711 A1 * 5/2012 Alexander ..... A61G 5/00 280/47.34
2012/0255118 A1 * 10/2012 Hammond ..... A61G 7/1017 5/86.1
2013/0221716 A1 * 8/2013 Purwar ..... A61G 7/1017 297/311
2013/0274640 A1 * 10/2013 Butters ..... A61H 3/008 601/35
2014/0179493 A1 * 6/2014 Hoebel ..... A61H 3/008 482/54
2015/0090308 A1 * 4/2015 Bos ..... A61G 5/14 135/67
2015/0190293 A1 * 7/2015 Hacikadiroglu ..... A61G 7/1017 5/87.1
2015/0216757 A1 * 8/2015 Powell ..... A61H 3/04 280/657
2015/0359692 A1 * 12/2015 Elnatan ..... A61G 5/14 297/183.1
2016/0143795 A1 * 5/2016 Schwartz ..... A61G 5/14 5/83.1
2016/0184151 A1 * 6/2016 Anderberg ..... A61F 5/37 5/648
2017/0056267 A1 * 3/2017 Stryker ..... A61N 1/36003

* cited by examiner

PATIENT ASSISTANCE AND REHABILITATION DEVICE AND METHOD OF USE

BACKGROUND OF THE INVENTION

The present invention relates generally to patient assistance and rehabilitation device or more specifically a patient mechanical lift device that can be utilized as patient walker, a seat, a seated transporter, a toilet, a table and a rehabilitation device.

Caring for the aging, incapacitated or invalid persons is a problem inherent with being human, and as we continue to improve medicine and health care, people are living significantly longer, thus creating a greater need for caretakers and a support structure for people having diminished physical capacity. However, it is also human nature to desire to be independent and take care of one's own personal needs whenever possible. For a person with diminished physical capacity, performing simple tasks such as, getting out of bed, travelling across a room, exercising and getting to the restroom may become milestones, or acts of great achievement, that will validate that person and fill them with strong sense of accomplishment and self-worth.

Due to the universal nature of the problem, there are myriad devices designed to help people having diminished physical capacity, this includes, wheeled furniture that has been in use for centuries, to walker/lift devices that have developed in recent years. The more recent devices include an INVALID LIFT AND TRANSFER DEVICE, U.S. Pat. No. 3,277,502, filed Sep. 25, 1964 to Wauthier or the PATIENT ASSIST DEVICE, U.S. Pat. No. 4,985,947, filed May 14, 1990, to Ethridge. Each of these devices have features that may help a person having diminished physical capacity but each of these devices also has limitations; the device of Wauthier can be used to raise a person into a standing position but only with the assistance of a second person pushing down on a mechanical lever positioned on the side of the device opposite the patient. Whereas, the device of Ethridge will allow a patient with diminished physical capacity to rise to a standing position on their own, however, this is only accomplished using a complicated cable and pulley assembly powered by an electric motor.

What is needed is a device having a simple mechanism which will allow a person having diminished physical capacity to rise into a standing position without necessarily requiring an assistant and the device providing additional functionality that will help accommodate the user throughout the day.

SUMMARY OF THE INVENTION

The present invention is a patient assistance and rehabilitation device, or more specifically a patient lift and transfer device having mechanical assistance which will allow a person or patient with minimally diminished capacity to move from a seated position at the edge of a bed, chair or similar device to a standing position with the aid of the patient lift and then use the lift as a walker. In the case of a more fully diminished patient, the lift is configured to allow an assistant to provide additional stabilization and lifting using an adjustable lift handle; the lift can include a sling seat, a split hard seat, a split toilet seat and a table top accessory.

A first embodiment of the present invention includes a rolling base assembly formed generally in a U-shape, the open side facing toward the rear of the device. A pair of adjustable upright members that extend vertically from each side of the rolling base assembly. A patient lift table assembly also formed generally in a U-shape is attached to the top of the upright members. The open portions of the U-shaped configuration of the rolling base assembly and the lift table assembly facing toward the rear of the device, allowing a patient to easily access the lift device. The adjustable upright members connect to the rolling base assembly toward the closed front of the lift in a foldable configuration. Attaching the upright members toward the front of the device allows the rolling base assembly to be moved at least partially under a bed or furniture and places a seated patient seated in a better position within the device to make the transition from seated to standing. The foldable configuration of the upright members allows the device to be collapsed to a reduced size for shipping or storage. The patient lift table is connected to the upright members toward the open portion of the U-shape in a pivotal configuration, or in a configuration where the patient lift table is allowed to pivot in a "sea-saw" motion front to rear. The connection point is configured to take advantage of the principal of a simple lever and fulcrum and multiply the force applied to the front of the patient lift table at the rear of the patient lift table. In one embodiment the force/lever ratio is 2:1, in other embodiments the ratio is 1.5:1, 2.5:1, 3:1 or 3.5:1 or another appropriate ratio, in yet another embodiment the force/lever ratio is variable. Patient handles are attached to the lift table forward of the pivot point, or fulcrum, opposite from the patient's body and allows the patient to lean into the device and apply pressure to the handles and create lift under elbows, upper arms and to the thighs through a seat assembly. This force is augmented by a tension motor or plurality of elastomeric power bands that are tensioned between the front of the rolling base assembly and the patient lift table assembly, the power bands biasing the front of the lift table down and applying additional force to help lift the patient.

In one embodiment of the present invention the patient assistance and rehabilitation device includes an incremental locking assembly or D-plate assembly at the junction between the upright members and the patient lift table. The D-plate assembly is configured to allow the patient lift table to move or pivot a certain number of degrees and then lock the patient lift table from moving back in the opposite direction. This function allows a patient to move the lift table, with assistance from the power bands, and then essentially rest, holding onto the patient handles or leaning into arm pads configured to receive the patient's forearms. When the patient is prepared, the patient can rock forward to add force to the handles and the lift table to move the D-plate assembly into the next incremental stop. This process can be repeated until the patient is in a standing upright position with the lift table tilting forward and functioning like supported crutches or the patient is seated and the patient lift table is substantially level.

The D-plate assembly is configured as a set of the three inter-locked plates having a central pivot, the innermost plate includes a direction handle, and a plurality of recesses formed around the lower perimeter, the central plate essentially mirrors the innermost plate, minus the handle, and acts as washer or slip plate between the innermost plate and the outermost plate. The central plate includes a plurality of elongate holes having a center point that matches the center point of the recesses formed in the perimeter of the innermost plate. The outermost plate includes a plurality of elongated holes or slots also having a center-point corresponding with the center point of the recesses formed in the innermost plate, the elongated holes have a chamfer or bevel on the outside surface. A spring-loaded locking plunger rod assembly is attached to the upright member and is configured to interface with the elongated slots and holes in the D-plate assembly. The plunger rod is chamfered on the outside end surface. The outermost plate also includes a plurality of limit slots formed in a radius between the elongate holes and the pivot point, each of the central slip plate and the inner-most plate have holes that correspond to the center point of the limit slots formed in the outer-most plate. A plurality of bolts and sleeve nuts are configured to pass through all three plates. With the bolt and sleeve nuts in place, the innermost plate and the central slip plate are aligned in a similar orientation with holes of the central plate concentric with the recesses of the innermost plate. The bolts and sleeve nuts restrict the movement of the outmost plate to the length of the limit slots. The length of the limit slots translate into angular movement of the outermost plate of between 5 and 10 degrees. When the direction handle of the inner-most plate is moved toward the front of the patient lift, the recesses of the innermost plate align with the back radius of elongate slots of the outermost plate and the outmost plate will engage the shaft of the plunger rod and restrict the lift table from rotating down on the patient side of the upright members. However, in this configuration a ramp is formed where the chamfered end of the plunger can ride up out of the recesses of the innermost plate, over the central glide plate and out of the chamfered edge of the elongate slot of the outermost plate and then incrementally drop into the next slot when downward pressure is applied to the front of the patient lift table. When the direction handle is moved in the opposite direction, or pulled back toward the patient, the patient lift table is restricted from pivoting up on the patient side of the upright members. In one embodiment a detent ball spring assembly is used to bias the D-plate assembly in the forward and backward position. If a user desires to lock the patient lift table in a fixed position, the D-plate assembly direction handles can be moved into opposing positions or where one side is moved forward and the other side is moved into the backward position.

In another embodiment, the plunger assembly rod is lockable in a retracted or open position which allows free rotational movement between the lift table and upright members. In this configuration the patient can use their arms or legs to exercise by pushing with their legs or pulling on the patient handles and moving the patient lift table against the pressure of the power bands. It is contemplated power bands may be added or removed from the front of the patient lift table to vary resistance during exercise. In one exercise the patient may plant their feet firmly on the floor and squat down using body weight against the tension of the power bands, the patient can hold this position in a "stabilized" squat and then rise up into a full standing position using the assistance of the power bands. One seated exercise allows a patient to place their feet on the front rolling frame cross bar and then pull back on the patient handles and rock back against the power band tension. This position may also be used to focus more fully on using the abdominal muscles or core to bend at the waist toward the front of the patient lift table and then focus the core to move back against the pressure of the power bands. It is contemplated that a multitude of different focused exercises may be developed using only the patient assistance and rehabilitation device or additional accessories such as yoga blocks or stretch bands.

In one embodiment of the present invention or patient assistance and rehabilitation device the power bands extend from front portion of the patient lift table down to a releasable rack or cross bar that is pivotally attached to the front cross brace of the rolling base assembly. The releasable rack allows an assistant to add or remove a plurality of power bands without being exposed to the full tension of the band and the attachment hardware which minimizes the risk of accidentally releasing a band before it is securely attached and having the elastomeric band retract and strike either the patient or assistant. After the desired number of power bands are attached to the releasable rack, the assistant can depress the rack using their foot to engage the power bands and engage a mechanism that locks the releasable rack against the front portion of the rolling base assembly. In one embodiment the releasable lock mechanism is disengaged in a two-step process of depressing the rack with one foot and using a lever on the patient lift table to disengage a latch mechanism. Once the latch mechanism is released the user can lift their foot to slowly disengage the pressure on the power bands.

In another embodiment of the present invention or patient assistance and rehabilitation device a supplemental lift handle is attached to the front portion of the patient lift table. The supplemental lift handle extends away from the lift table to allow an assistant to provide additional lifting force when moving a patient into a standing position. In one embodiment the supplemental lift handle can be rotated and locked in a variety of positions. The lift handle including a releasable locking cog that is configured to engage a plurality of the slots arranged in a radial pattern that is concentric with the front cross-bar portion of the patient lift table. The supplemental lift handle can be moved into a position facing the patient and may be used by the patient as an alternate grab bar or hand rest. Or it may be released and locked into an upright position which allows an assistant to pull, rather push down on the handle, when providing additional force to lift a patient into a standing position. The supplemental lift handle provides the greatest force moment when the handle is in a position facing away from the patient and in the same plane as the patient lift table.

One embodiment of the present invention includes a sling seat that is attached to the rear portion of the patient lift table and can be used to support a patient during transit or to allow the patient to remain in the device in a comfortable seated position. It is contemplated that the sling is placed under a patient's thighs while the patient is in a seated position near the edge of a bed or chair. Once the sling seat is under the patient, a padded front support strap is pulled up through the patient's thighs and the seat and padded front support strap are connected to the lift table using seat attachment knobs. In another embodiment a back brace or support is additionally attached to the lift table and is configured to engage the patient's lower back and provide additional support and overall comfort.

In one embodiment of the present invention a conventional seat may be added in lieu of the sling seat. The conventional seat is configured as two interlocking halves which are attached in a pinned swinging configuration to the upright support members. When a user is standing with the assistance of the lift table the conventional seat halves can be swung in under the patient and locked into a fixed position. The conventional seat is configured for maximum comfort when a patient chooses to spend extended periods of time in the patient assistance and rehabilitation device.

In another embodiment of the present invention includes a toilet seat with a waste pan that can be placed under the patient and allow the patient to sit while eliminating waste. In one embodiment the toilet seat is one piece which swings in under the patient and mates with a secondary support that is attached to the opposing upright support member. In another embodiment the toilet seat is a split seat divided approximately equally in half, as such, each half is attached to support bracket which is pivotally pinned to the upright support members. In each embodiment a waste collection pan is configured to attach under the toilet seat. An assistant can readily remove the pan for waste disposal and cleaning.

In one embodiment of the present invention a work surface or table is configured to be releaseably attached to the top of the patient lift table portion. The table top may substantially be a rectangular shape that covers the front portion of the lift table or the table top may include extensions or wings that wrap back around the side of the patient. The table top may be configured to include such accessories as a storage compartment, cup holder, recessed pockets for small items, spill lips or a ridge to prevent round objects from rolling off of the table top.

In one embodiment the patient assistance and rehabilitation device will include an adjustable height mechanism at the upright support members, extendable length for the rear tubes of the patient lift table, forward extension of the patient lift table, and accessories such as brakes configured to lock at least one wheel on the rolling base.

These and other features and advantages of the disclosure will be set forth and will become more fully apparent in the detailed description that follows and in the appended claims. The features and advantages may be realized and obtained by the instruments and combinations particularly pointed out in the appended claims. Furthermore, the features and advantages of the disclosure may be learned by the practice of the methods or will be obvious from the description, as set forth hereinafter.

BRIEF DESCRIPTION OF DRAWINGS

The following description of the embodiments can be understood in light of the Figures, which illustrate specific aspects of the embodiments and are part of the specification. Together with the following description, the Figures demonstrate and explain the principles of the embodiments. In the Figures the physical dimensions of the embodiment may be exaggerated for clarity. The same reference numerals in different drawings represent the same element, and thus their descriptions may be omitted.

DETAILED DESCRIPTION OF THE INVENTION

Figure 1:
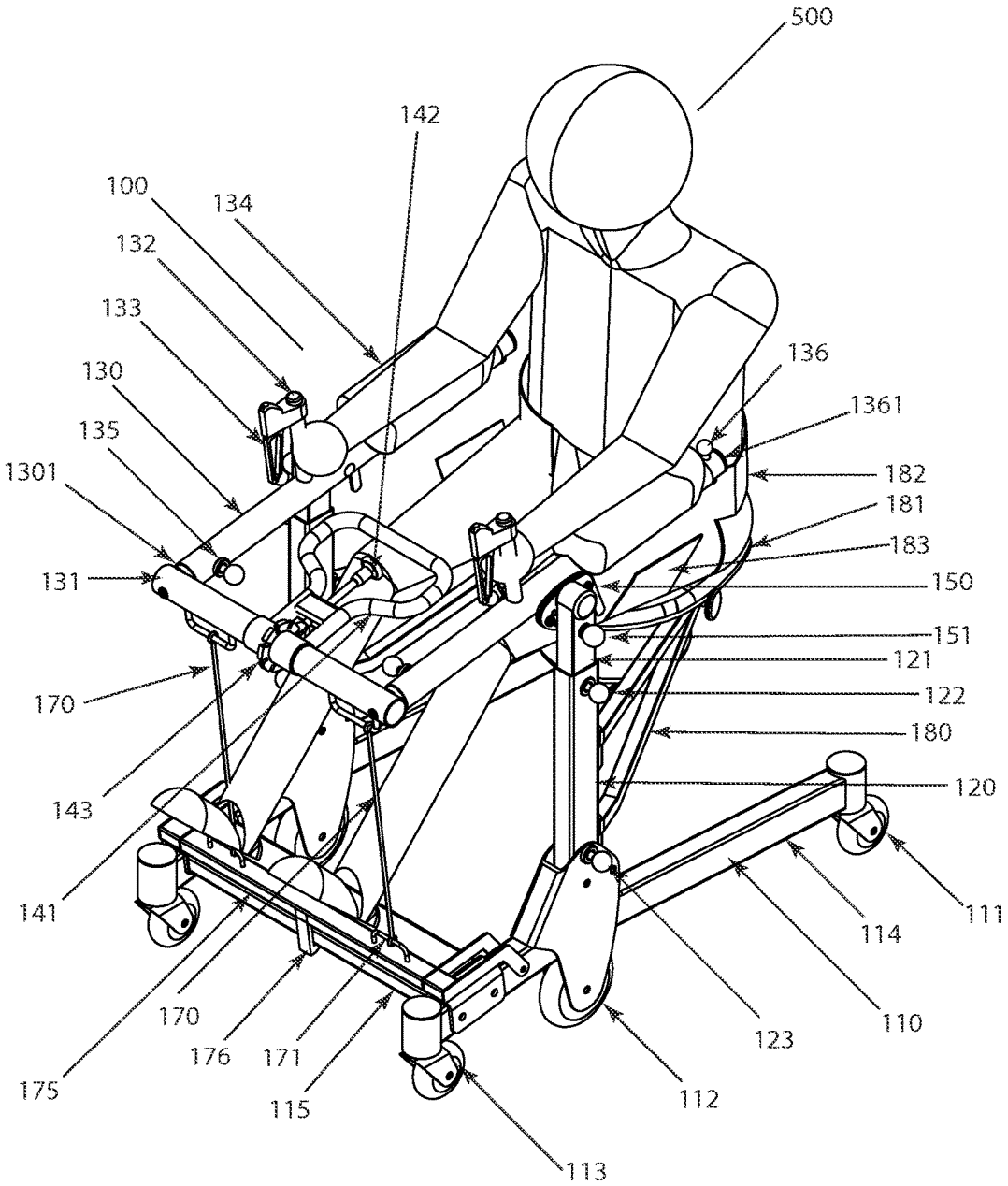
FIG. 1 illustrates one embodiment of the present invention or patient assistance and rehabilitation device with a seated patient.
Figure 2:
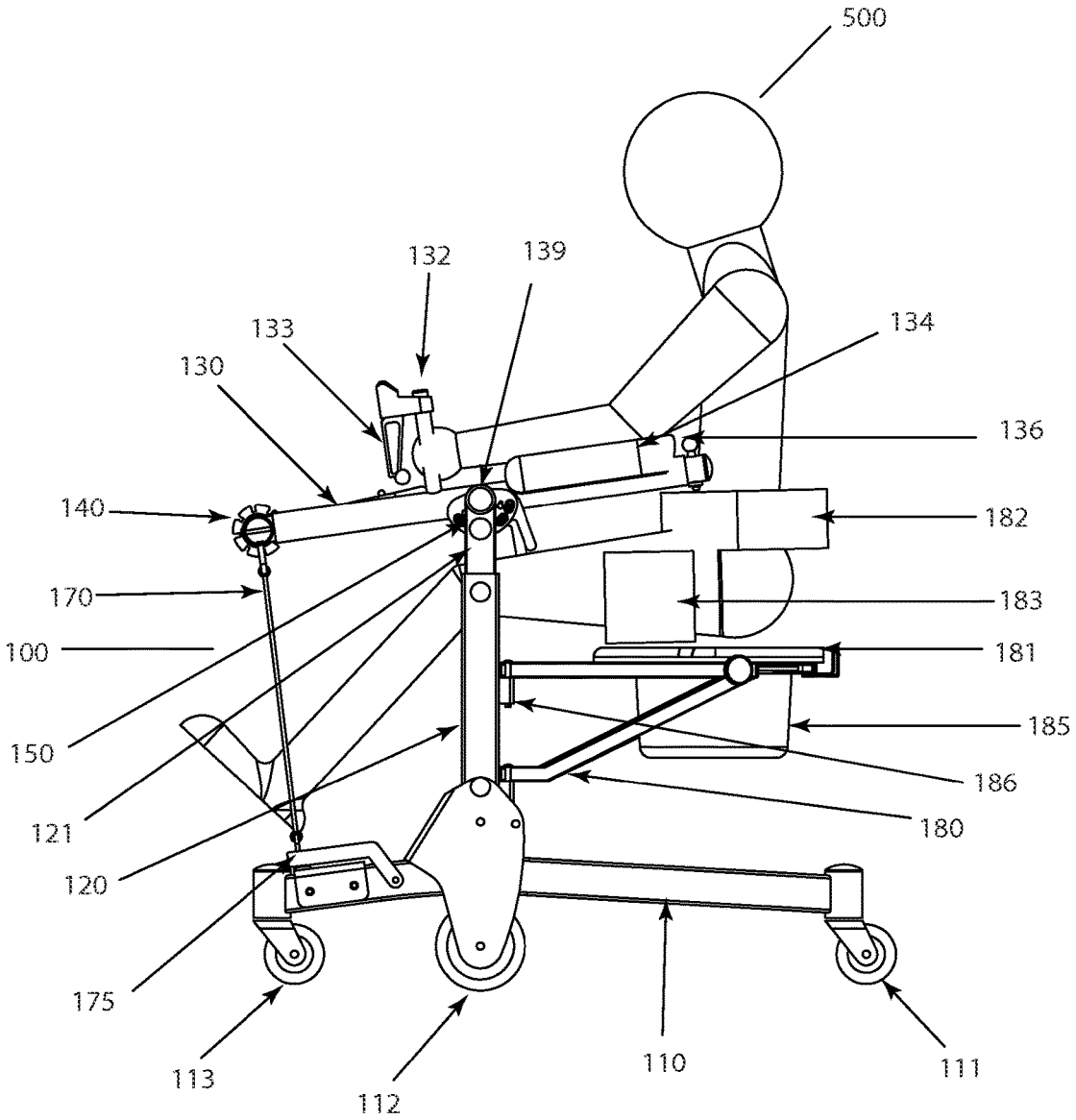
FIG. 2 illustrates a side view of one embodiment of the present invention or patient assistance and rehabilitation device.
Figure 3:
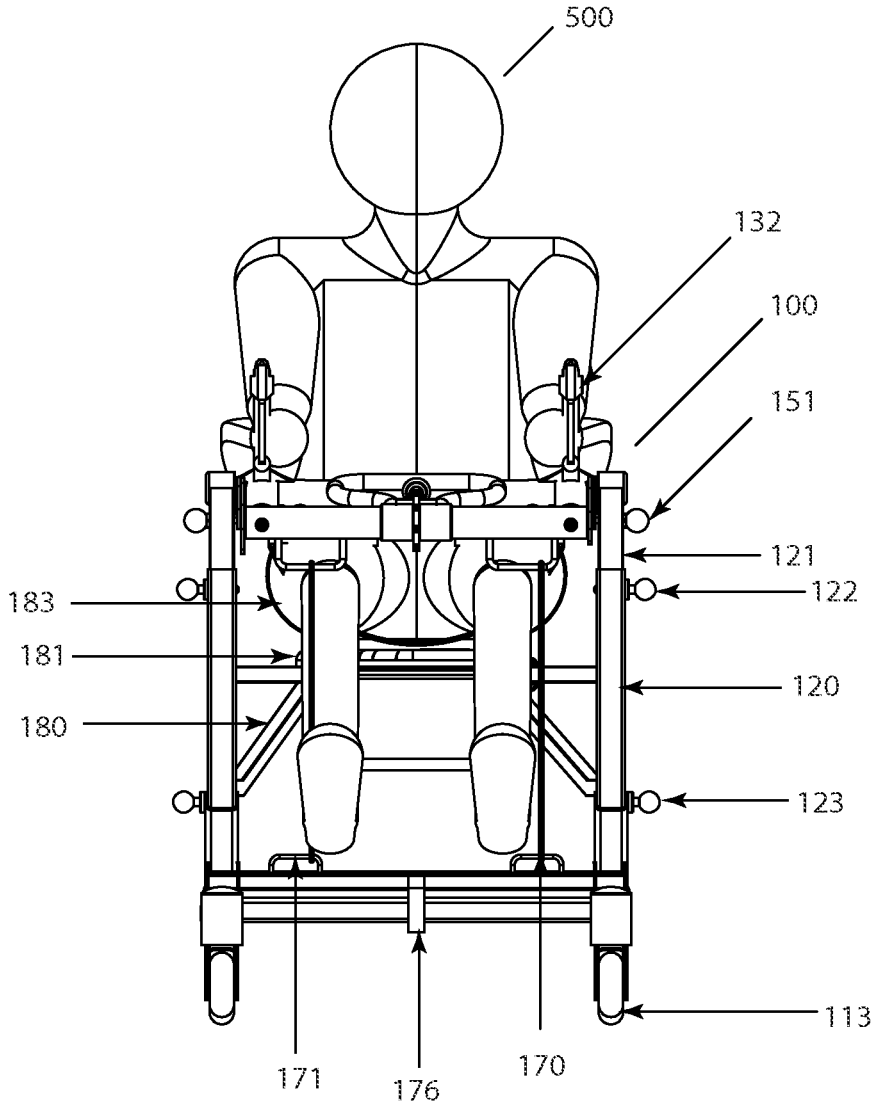
FIG. 3 illustrates a front view of one embodiment of the present invention or patient assistance and rehabilitation device.
Figure 4:
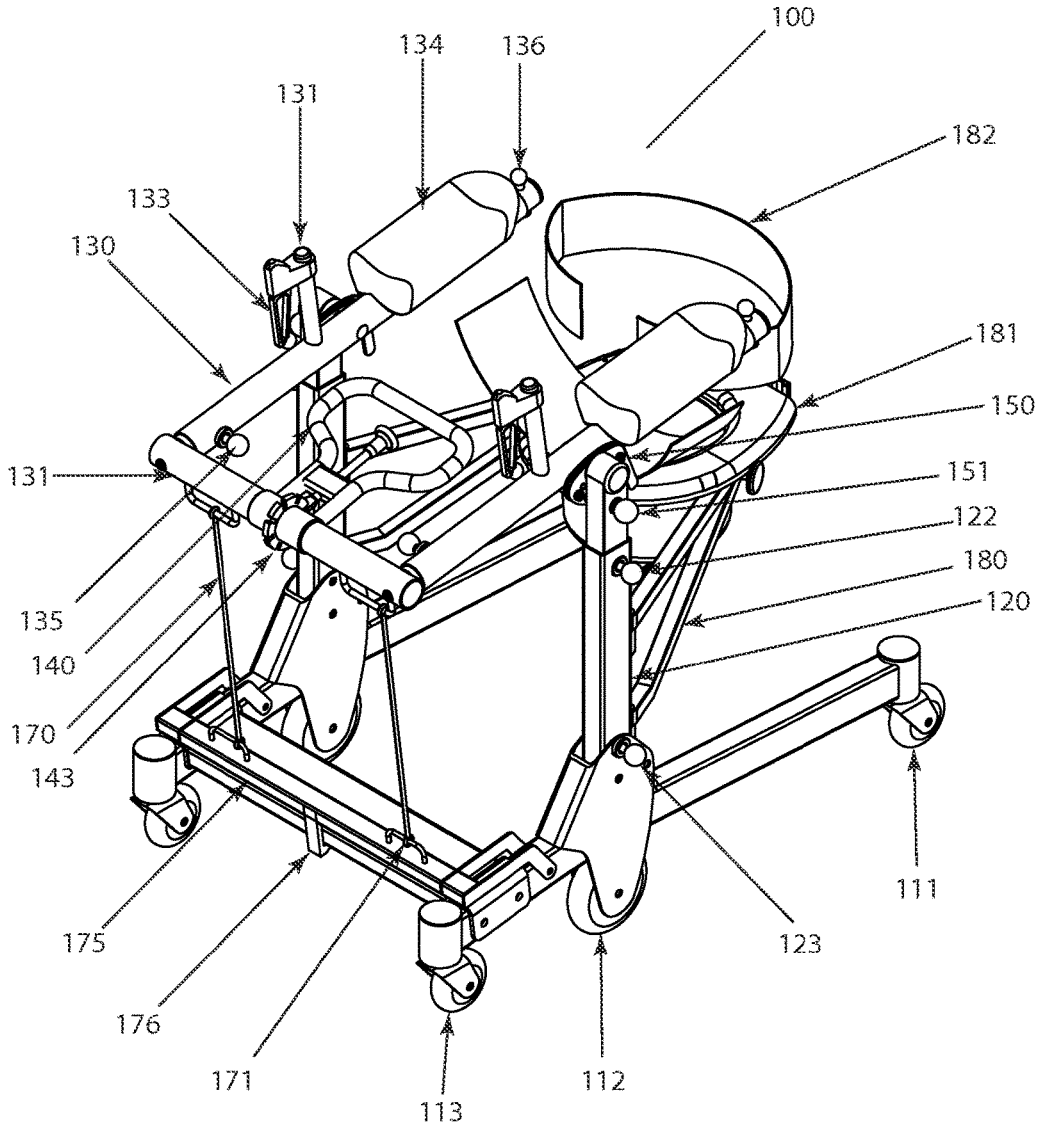
FIG. 4 illustrates a perspective view of one embodiment of the present invention or patient assistance and rehabilitation device.
Figure 5A:
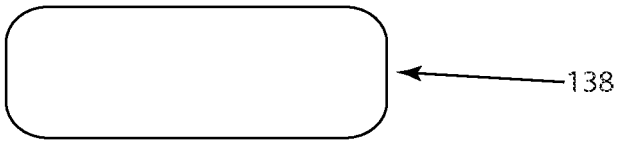
FIGS. 5A and 5B illustrate a table top and a side view of one embodiment of the present invention or patient assistance and rehabilitation device.
Figure 5B:
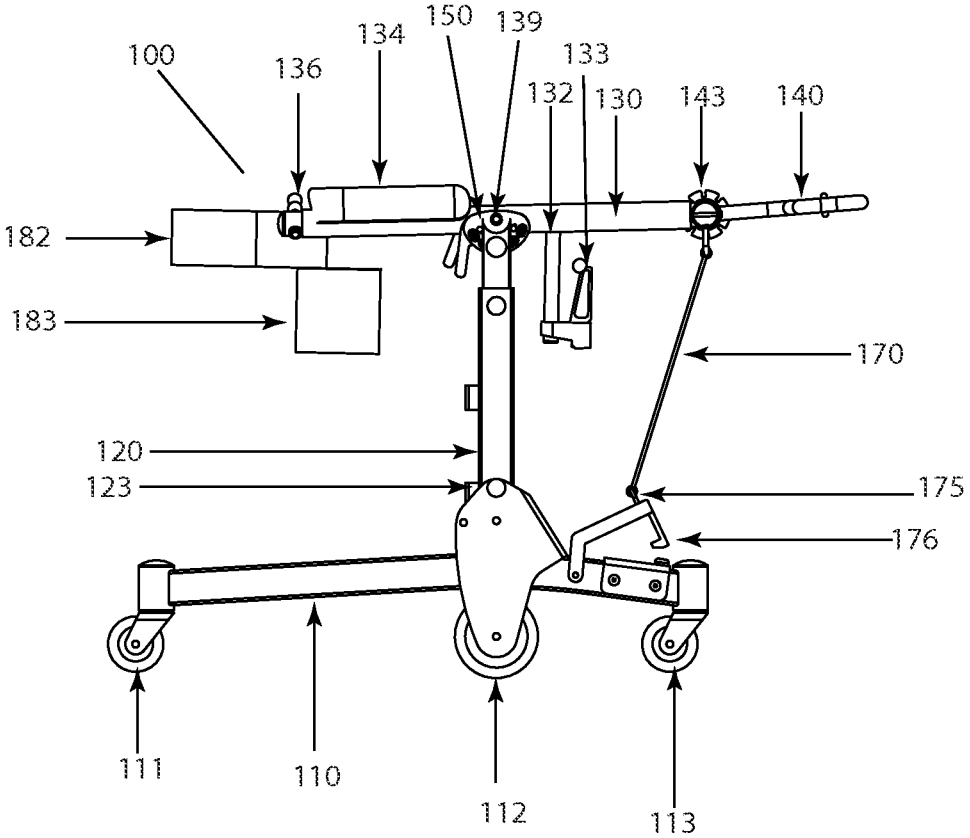

For the purposes of promoting an understanding of the principles in accordance with the disclosure, reference will be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure.

As used in this specification and the appended claims, the singular forms "a," "an," and "the" include plural referents unless the context clearly dictates otherwise. In describing and claiming the present disclosure, the following terminology will be used in accordance with definitions set out below. As used herein, the terms "comprising," "including," "containing," "characterized by," and the grammatical equivalents thereof are inclusive or open-ended terms that do not exclude additional, unrecited elements or method processes.

Illustrated in FIGS. 1 through 6 is of one embodiment of the present invention or patient assistance and rehabilitation device 100, some of the figures include a seated patient 500. Patient assistance and rehabilitation device 100 includes as major components, the rolling base assembly 110, upright support members 120 and the patient lift table 130. The rolling base assembly 110 is generally a U-shaped frame assembly having two base side rails 114 and a front cross brace 115; the rear rolling base assembly 110 is open to allow patient access and to allow the patient to stride or move their feet. The rolling base assembly includes a rear caster 111, a central wheel 112 and front caster 113. In this configuration the patient assistance and rehabilitation device 100 is a stable platform that can be easily turned and maneuvered, when a side pressure or rotational force is applied, both the rear caster 111 and front caster 113 will move into a trailing position perpendicular to the central wheel 112 and allow the device 100 to pivot or turn in a radius approximately the same as the wheel base between the opposing central wheels 112. In one embodiment of the present invention a brake assembly (not shown) is configured to engage at least one of the central wheels 112. It is contemplated that the brake is biased into a closed or locked position where the user must first engage a hand lever 133 before the patient assistance device 100 can be moved.

Upright support members 120 are pivotally connected to the rolling base assembly 110 having a locking pin 123 to maintain support members 120 in an upright position. The patient lift table assembly 130 it pivotally attached to the upper end of the upright support members 120. The upright support members 120 are also extendable to adjust the patient lift table height; this is accomplished by releasing the height locking pin 122 and extending an inner support tube 121, the inner support tube 121 having a plurality of the height adjustment holes (not shown) configured to engage the shaft of height locking pin 122. The attachment point between the upright support members 120 and patient lift table 130 includes a releasable incremental locking mechanism or a D-plate assembly 150. Additionally, the attachment point between the upright support members 120 and patient lift table 130 creates a fulcrum 139 and is configured to multiply force that is applied to the front portion of the lift table 130 and patient handles 132, using the principle of simple levers, to the back portion of the lift table 130 and use that force to help a patient move from a seated to a standing position by supporting and lifting the patient by the forearms and thighs. The pressure to the forearms is evenly distributed by armrest pads 134, the patient may also steady themselves using the patient handles 132. The D-plate assembly 150 allows a patient to incrementally move into a standing position, as the patient raises, the D-plate will index forward and lock backwards against pivot pin assembly 151. The D-plate 150 indexing mechanism allows the patient to rest in a partially standing position and prevents the patient from falling back fully to the original seated position.

If a patient has further diminished physical capacity additional force from a one or more power bands 170 that extend from essentially the front cross bar 115 to the patient lift table cross bar 131, can be used. The power bands apply additional downward force against the front portion of the lift table 130 to help a patient move into a standing position. In one embodiment, the power bands 170 are connected to the rolling base 110 using a releasable power band rack 175, the power band rack 175 is configured to remove the tension from the power bands 170, to preserve the elasticity of the bands 170, to provide easier installation of individual power bands 170 on connection loops 171 and reduce the risk associated with tensioned elastic materials. Rack 175 is configured to be released by having an assistant first depress the top portion of rack 175 with a foot to relieve pressure from locking mechanism 176 and then pulling lever or handle (not shown) located on top of the patient lift table to disengage the latch mechanism 176 from cross bar 115.

In one embodiment of the present invention a supplemental lift handle 140 is provided, the supplemental lift handle 140 includes a lift assistance handle 141 which is attached to the lift table cross bar 131 with a ratchet assembly 143. The ratchet assembly 143 is comprised of a metal ring having a plurality of the radial slots that is attached concentric with the lift table cross bar 131 and is engaged in by a dog or pawl that is actuated by a spring biased release knob 142. When knob 142 is pulled, the patient lift assistance handle 141 can be moved incrementally in relationship to the patient lift table cross bar 131. When handle 141 is extended away from the lift table 130 in a plane parallel to the lift table 130 an assistant is afforded the maximum leverage when lifting a patient by pushing down on handle 141. An assistant or aide may choose a variety of angles or positions for the patient lift assistance handle 141 depending on the size of the assistant, the perceived comfort of using each position, and the amount force necessary to lift the patient.

In another embodiment of the present invention the patient lift table 130 is extendable both at the front and in the rear. If a larger patient or a patient with longer arms is using the device, the front portion of the lift table 130 can be extended by releasing lock pin 135 and extending out an inner patient lift table tube section 1301. The rear portion of the lift table can be extended by releasing a similar knob and extending the rear patient lift table inner tube sections 1361.

Figure 9:
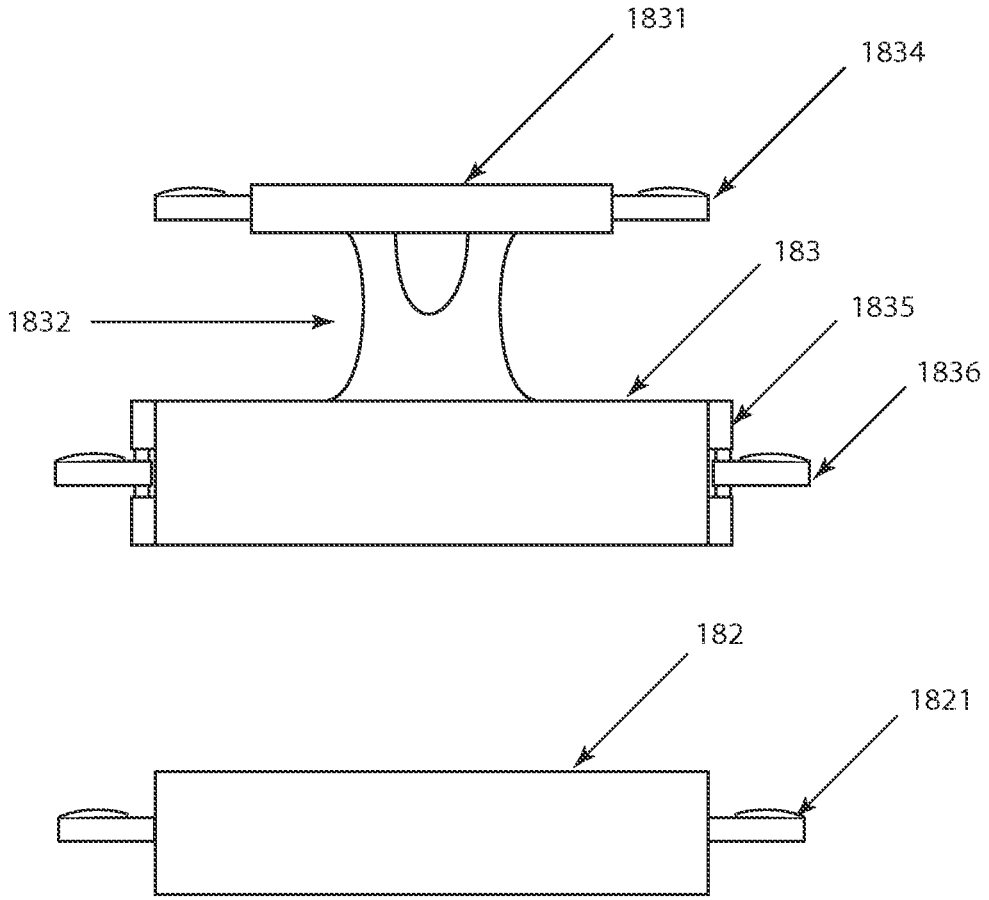
FIG. 9 illustrates a sling seat and backrest assembly.

Another embodiment of the present invention or patient assistance and rehabilitation device 100 a plurality of other assemblies or accessories which allows a patient to sit are included. In a first embodiment a sling seat 183 and backrest 182 is included as shown in detail FIG. 9. The sling seat is attached to the seat attachment knobs 136 at attachment loops 1836 and the sling seat 183 can be extended under the patient while the patient is in a sitting position on the edge or a bed or chair and used to raise the patient into a sitting or standing position within the patient assistance and rehabilitation device 100. A padded front support strap 1831 can be pulled between the patients legs and secured to attachment knobs 136 at front strap attachment loops 1834. The front support strap 1831 in combination with a padded connection support 1832 secures the patient in sling seat 183 and prevents the patient from sliding or slumping forward. Spreader rods 1835 are incorporated to prevent the fabric or material of sling seat 183 from bunching and to keep the sling seat 183 in a flat configuration. In another embodiment an additional back support strap 182 with back strap connection loops 1821 is provided to give the patient additional back support when remaining seated in the device for an extended period of time.

Figure 10A:
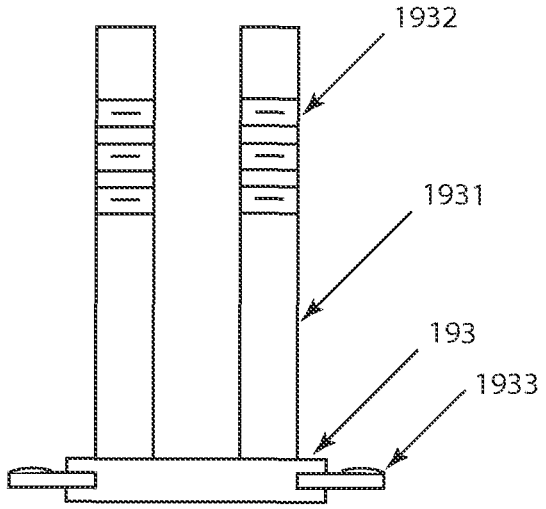
FIG. 10A illustrates a toilet assist sling seat in a first position.
Figure 10B:
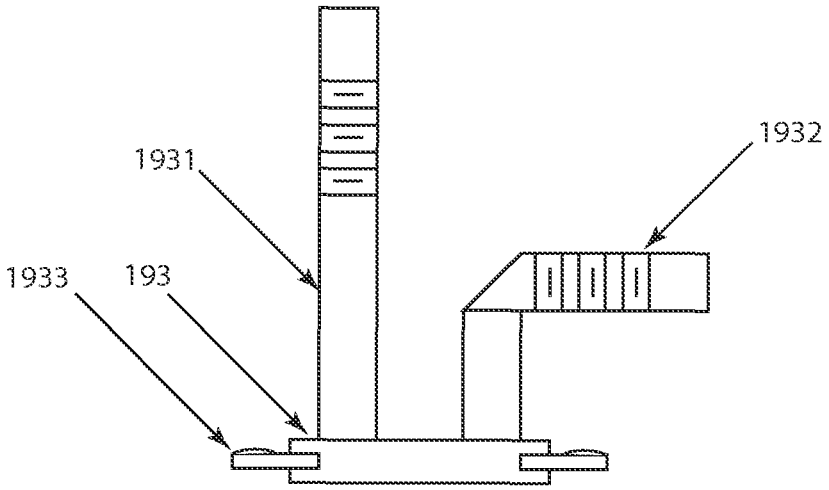
FIG. 10B illustrates a toilet assist sling seat in a second position.

In yet another embodiment a toilet seat 181 can be provided to allow a diminished patient to eliminate waste without getting out of the device 100. The toilet seat 181 can be fitted with a removable waste pan 185. It is also contemplated that the toilet seat 181 can be used in accompaniment with a secondary toilet sling seat 192 as shown in FIGS. 10A and 10B. The toilet sling seat 192 is configured to be placed under a patient's thighs and suspended from attachment knobs 136 using the toilet sling seat attachment loops 1933. The leg straps 1931 are wrapped around the inside of patent's thighs (see folded sling strap 1931 in FIG. 10B) before they are also connected to knobs 136 at one of a plurality of connection slots 1932. The toilet sling 192 is beneficial when moving a patient onto the toilet seat 181 and positioning the patient's thighs in an open position for cleaning and patient hygiene.

In another embodiment, a split conventional seat is provided (not shown), the conventional seat may be attached to seat support brackets 180 which rotate on hinge pins 186.

In another embodiment of the present invention a table top 138 (FIG. 5A) can be fitted to the patient lift table 130.

Figure 6:
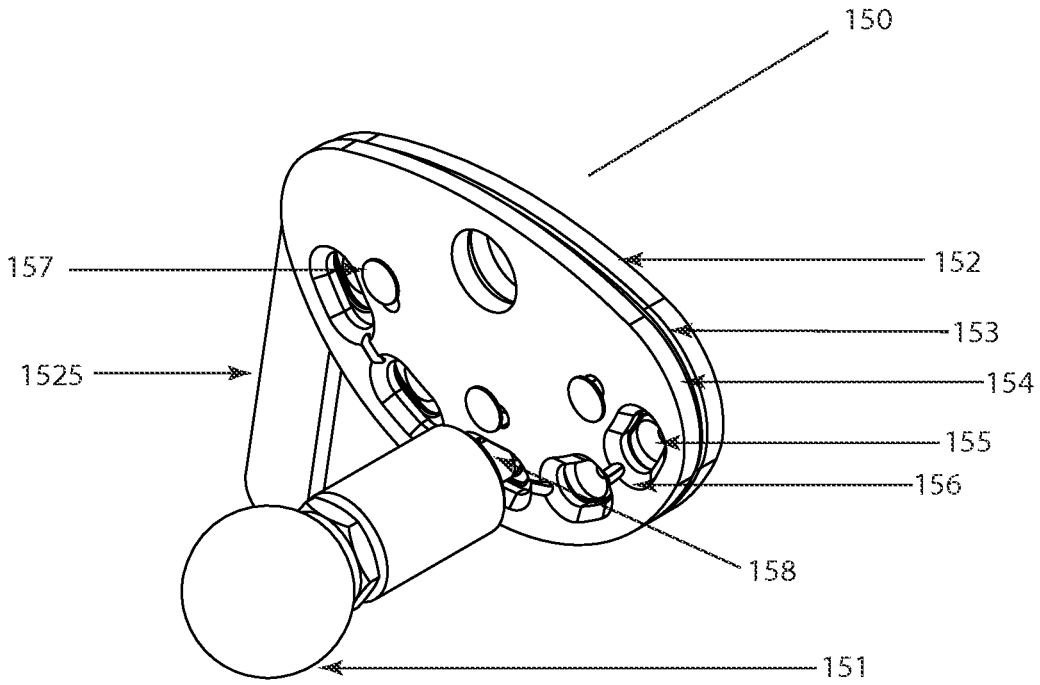
FIG. 6 illustrates a locking D-plate assembly.
Figure 7:
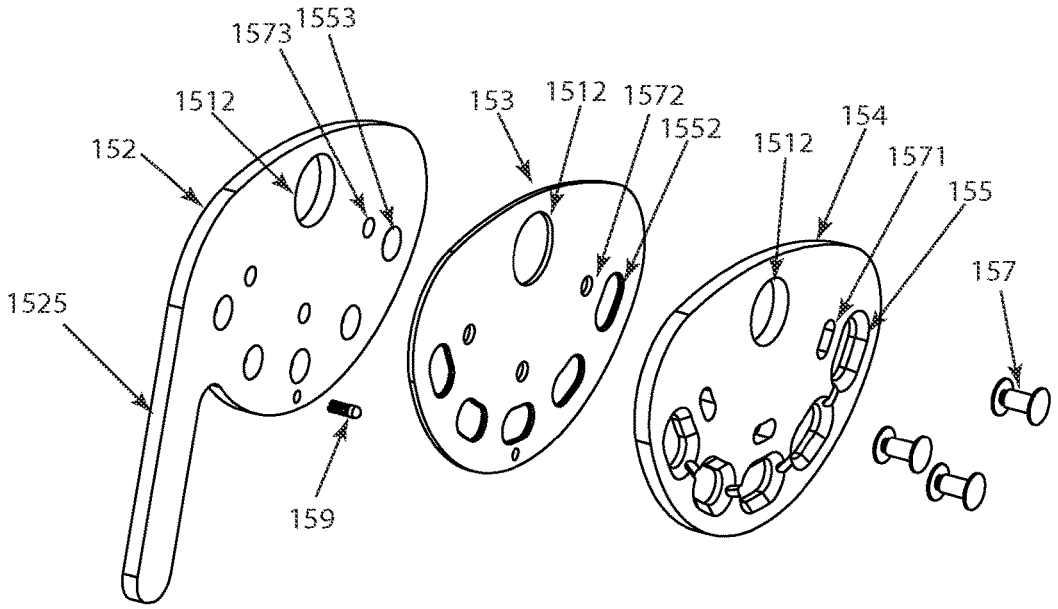
FIG. 7 illustrates an exploded view of a locking D-plate assembly.
Figure 8:
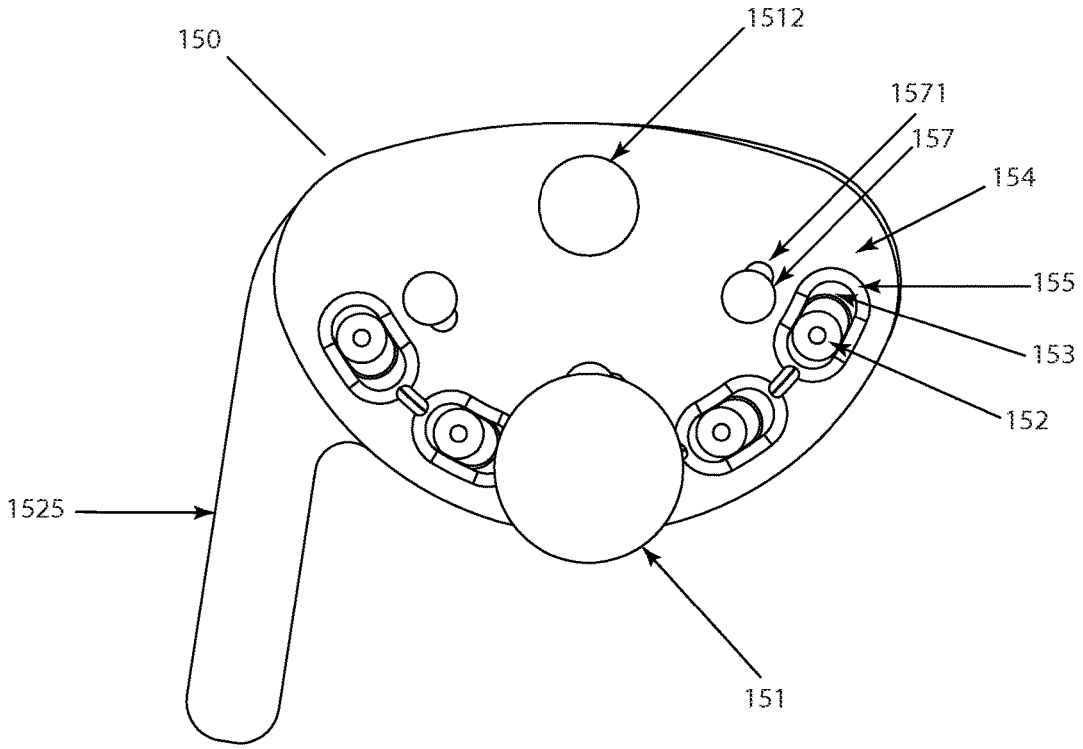
FIG. 8 illustrates a front view of a locking D-plate assembly in a forward locked position.

FIGS. 6, 7 and 8 illustrate an embodiment of the locking and indexing assembly for the patient lift table 130 or more specifically an embodiment of the D-plate assembly 150. The D-plate assembly 150 is primarily comprised of the three interacting plates with each plate having substantially the same semi-circular shape or profile and each plate rotates around a central axis having a pivot hole 1512 configured to receive the shaft of a connecting pin or bolt that joins the upright support members 120 and patient lift table 130. The innermost plate 152 comprises a semi-circular shape having a lock control handle 1525 extending perpendicular to one edge. The innermost plate 152 includes a plurality of index recesses 1553 formed on the inside surface proximate the outer edge of the semicircular portion. The central plate 153 is formed using a material such as nylon or high density polyethylene to primarily provide a slip plane between the innermost plate 152 and the outermost plate 154. The central plate 153 includes a plurality of elongated index holes 1552 having a center point which correspond to the index recesses 1553 of the innermost plate 152. The outermost plate includes a plurality of elongated index holes 155 which again correspond to the recesses 1553 of the innermost plate. The index holes 155 of the outermost plate 154 include a chamfered outside edge 156. The outermost plate also includes a plurality rotation limit slots 1571 which are formed in an arc between the pivot hole 1512 and the elongated index holes 155. Each of the innermost plate and the central plate having drilled holes 1572 and 1573 that correspond with the limit slots 1571. Also included between plates is a centering spring and ball detent 159 configured to bias toward or indicate the forward and backward positions of the indexed plates. When assembled the innermost plate 152 will have the central slip plate 153 stacked on and then the outermost plate 154 and then a plurality of sleeve bolts 157 that extend through the limit slots 1571 and the drilled holes 1572 and 1573. As shown in FIG. 8 when the handle 1525 is pulled back, this causes the innermost plate 152 and the central plate 153 to move a limited number of degrees in relationship to the outermost plate 154 in this position the front portion of the elongate holes 155 will form a shoulder that retains the spring loaded plunger rod 158 of the plunger assembly 151. However, rear portion will create a ramp that allows a chamfered end of the plunger rod 158 to ride up out of the recess 1153, over central plate 153 and out of the elongated slot 155 and then fall into the next corresponding elongated slot 155. This operation is reversed if handle 1525 is pushed forward away from the patient and moves the blocking shoulder to the back portion of the elongate holes 155. Plunger assembly 151 includes a locked open position that allows the patient lift table to rock or "sea saw" back and forth unrestricted.

The invention claimed is:

1. A patient assistance and rehabilitation device comprising:

a rolling base assembly, the rolling base assembly having a u-shaped configuration including, a front cross member, two elongate side members having, a mid-point, a free end and an end attached to the opposing ends of the front cross member, a patient lift table assembly, the patient lift table assembly having a u-shaped configuration including, a front cross member, two elongate side members having, a fulcrum point, a free end and an end attached to the opposing ends of the front cross member, two directional ratchet assemblies, two upright support members, a first end of each of the upright support members attached to one of the base assembly side members at the mid-point of the side member, one of the directional ratchet assemblies attached at a second end of each of the upright support members, the fulcrum point of the of the two elongate side members of the patient lift table connected to the directional ratchet assemblies forming a pivotal junction between the upright support members and the patient lift table, the base assembly front cross member and the patient lift table front cross member having the same orientation, the patient lift table front cross member above the base assembly front cross member, and, a plurality of elastomeric power bands attached under tension between the base assembly front cross member and the patient lift table front cross member biasing the front of the patient table down and providing a lifting force at the free ends of the patient lift table elongate side members.

2. The device of claim 1 wherein each directional ratchet assembly comprising;

an inner plate, a central slip plate, an outer plate, the three plates having an interconnected central pivot at the top portion and a lower perimeter formed as a radius, the inner plate having;

a direction handle formed tangential to the lower perimeter and extending below the lower perimeter, a plurality of circular recesses formed in a radial pattern near the lower perimeter, a plurality of holes formed in a radial pattern between the central pivot and the plurality of circular recesses, the central slip plate having;

a plurality of elongate holes formed in a radial pattern near the lower perimeter, a plurality of holes formed in a radial pattern between the central pivot and the plurality of elongate holes, the outer plate having;

a plurality of elongate holes formed in a radial pattern near the lower perimeter, a plurality of elongate limit slots formed in a radial pattern between the central pivot and the plurality of elongate holes, the inner plate, the central slip plate and the outer plate placed in a stacked configuration, a plurality of sleeve nuts installed through the limit slots of the outer plate and the plurality of holes between the central pivot and the plurality of elongate holes of the central slip plate and the plurality of holes between the central pivot and plurality of recesses formed in the inner plate, and, a spring loaded plunger configured to insert through the elongate holes near the lower perimeter of the outer plate and the central slip plate and engage the recesses formed in the inner plate.

3. The device of claim 2 wherein the directional handle has a first position which allows the spring loaded plunger to index forward through the plurality of elongate holes formed near the lower perimeter of the outer plate and the spring loaded plunger is restricted from indexing backward.

4. The device of claim 2 wherein the directional handle has a second position which allows the spring loaded plunger to index backward through the plurality of elongate holes formed near the lower perimeter of the outer plate and the spring loaded plunger is restricted from indexing forward.

5. The device of claim 2 wherein the directional handles of each of the directional ratchet assemblies can be moved into opposite positions restricting the spring loaded plunger from indexing forward and backward.

6. The device of claim 2 including a detent that aligns the directional handle in the first position and the second position.

7. The device of claim 2 wherein the spring loaded plunger can be locked in an open position.

8. The device of claim 1 including a supplemental lift handle attached to the front cross member of the patient lift table.

9. The device of claim 8 wherein the supplemental lift handle includes a plurality of radial slots and a releasable locking cog allowing the supplemental lift handle to be incrementally locked.

10. The device of the claim 1 including a releasable power band rack attached to the front cross bar of the rolling base assembly.

11. The device of claim 10 including a locking latch which is configured to be released by depressing the rack and actuating a hand lever.

12. The device of claim 1 wherein the upright support members are foldable.

13. The device of claim 1 including a sling seat assembly configured to be attached to patient lift table on seat attachment knobs.

14. The device of claim 1 including a toilet seat assembly comprising;

a pair of support brackets attached to the upright support members, the support brackets in hinged configuration, a toilet seat fixedly attached to at least one of the pair of support brackets, and, the toilet seat supported by the pair of support brackets.

15. The device of claim 14 including a removable waste pan.

16. The device of claim 14 including a supplemental toilet sling seat having patient thigh straps.

17. A method of using a patient assistance and rehabilitation device comprising:

providing a patient assistance and rehabilitation device having;

a u-shaped rolling base assembly having, a pair of elongate side members, a front cross member, a u-shaped patient lift table assembly having, a pair of elongate side members, a front cross member, a first end of a pair of upright support members attached at the mid-point of the pair of elongate side members of the rolling base assembly, a directional ratchet assembly attached to a second end of the upright support members, the directional ratchet assemblies having, a ratchet forward configuration, a ratchet backward configuration, a locked position, a fulcrum point of the elongate side members of the patient lift table assembly attached to the directional ratchet assembly, the patient lift table allowed to pivot front to back, a spring loaded plunger configured to incrementally engage a plurality of elongate slots formed in the directional ratchet assembly, a supplemental lift handle, a plurality of elastomeric power bands attached under tension between a releasable power band rack attached to the cross member of the rolling base assembly and the cross member of the patient lift table, a seat assembly configured to attach to the patient lift table, seating a patient on the side of a bed;

positioning the patient assistance and rehabilitation device toward the patient with the open portion of the u-shape under the bed;

positioning the lift table so the open portion of the u-shape is angled downward;

positioning the patient so the arms are on the elongate side members of the patient lift table with the torso leaning forward beyond the fulcrum point;

positioning the seat assembly under the patient's thighs;

attaching the seat assembly to the patient lift table;

moving the directional ratchet assembly to the ratchet forward position;

applying force to the forward portion of the patient lift table to cause the spring loaded plunger to index forward to the next elongate slot formed in the directional ratchet assembly and cause the patient to be lifted by the arms and thighs;

the applying force may be one or more of;

the patient applying downward force to the forward portion of the patient lift table, tension applied by the elastomeric power bands, and, an aide applying force to the supplemental lift handle, moving the patient into a desired position, and;

moving the directional ratchet assemblies to the locked position.

18. The method of claim 17 including releasing the power band rack by, stepping on the power band rack, and, actuating a release lever.

19. The method of claim 17 including adding to or removing from the plurality of elastomeric power bands to change the tension.

20. A method of using a patient assistance and rehabilitation device comprising:

providing a patient assistance and rehabilitation device having;

a u-shaped rolling base assembly having, a pair of elongate side members, a front cross member, a u-shaped patient lift table assembly having, a pair of elongate side members, a front cross member, a pair of handles, a first end of a pair of upright support members attached at the mid-point of the pair of elongate side members of the rolling base assembly, a directional ratchet assembly attached to a second end of the upright support members, the directional ratchet assembly having, a ratchet forward configuration, a ratchet backward configuration, a locked position, a fulcrum point of the elongate side members of the patient lift table assembly attached to the directional ratchet assembly, the patient lift table allowed to pivot front to back, a spring loaded plunger configured to incrementally engage a plurality of elongate slots formed in the directional ratchet assembly, the spring loaded plunger having a locked open position, a plurality of elastomeric power bands attached under tension between the cross member of the rolling base assembly and the cross member of the patient lift table, a seat assembly configured to attach to the patient lift table, positioning a patient in the patient assistance and rehabilitation device in a seated position;

moving the spring loaded plunger in the locked open position;

the patient applying force to the patient lift table handles to pivot the patient lift table back against the tension of the power bands, and;

adding or subtracting power bands to change tension.

* * * * *